US009635738B2

(12) United States Patent
Joppi et al.

(10) Patent No.: US 9,635,738 B2
(45) Date of Patent: Apr. 25, 2017

(54) ILLUMINATION SYSTEM WITH AN AUTOMATIC LIGHT IDENTIFICATION SYSTEM FOR LOCATION-DEPENDENT LIGHTING CONFIGURATION, AND A METHOD FOR OPERATING AN ILLUMINATION SYSTEM

(71) Applicant: ZUMTOBEL LIGHTING GMBH, Dombirn (AT)

(72) Inventors: Rene Joppi, Dornbirn (AT); Gregor Mayr, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 15/102,432

(22) PCT Filed: Dec. 17, 2014

(86) PCT No.: PCT/EP2014/078148
§ 371 (c)(1),
(2) Date: Jun. 7, 2016

(87) PCT Pub. No.: WO2015/091604
PCT Pub. Date: Jun. 25, 2015

(65) Prior Publication Data

US 2016/0360595 A1 Dec. 8, 2016

(30) Foreign Application Priority Data

Dec. 18, 2013 (DE) ..... 10 2013 226 413

(51) Int. Cl.
*H05B 37/02* (2006.01)

(52) U.S. Cl.
CPC ..... *H05B 37/0227* (2013.01); *H05B 37/0245* (2013.01); *H05B 37/0272* (2013.01)

(58) Field of Classification Search
CPC ..... H05B 37/0227; H05B 37/0245; H05B 37/0272
See application file for complete search history.

(56) References Cited

U.S. PATENT DOCUMENTS 8,872,442 B2 * 10/2014 Fushimi ..... H05B 37/02 315/149
8,918,118 B2 12/2014 Zudrell-Koch
(Continued)

FOREIGN PATENT DOCUMENTS

DE 202006011684 8/2007
DE 102010038792 2/2012
(Continued)

OTHER PUBLICATIONS

International Search Report for PCT/EP2014/078148, English Translation attached to original, Both completed by the European Patent Office on Mar. 4, 2015, All together 7 Pages.
(Continued)

*Primary Examiner* — Don Le
(74) *Attorney, Agent, or Firm* — Brooks Kushman P.C.

(57) ABSTRACT

An illumination system which contains a mobile operating device, a plurality of lights, and a central control device. The control device is designed to control the lights. The operating device includes a position-sensing unit for determining the position of the operating device and additionally contains a display unit on which the positions of the lights and the position of the operating device can be displayed in combination. The operating device thus allows a user to select and operate the lights that are displayed. The lights are controlled using the central control device according to the user's input.

15 Claims, 4 Drawing Sheets

(56) References Cited

U.S. PATENT DOCUMENTS

| | | | | |
|---|---|---|---|---|
| 2010/0081375 | A1 | 4/2010 | Rosenblatt et al. | |
| 2011/0298379 | A1* | 12/2011 | Jung | H05B 33/086 315/149 |
| 2012/0126721 | A1 | 5/2012 | Kuenzler et al. | |
| 2012/0242254 | A1* | 9/2012 | Kim | H05B 37/0272 315/312 |
| 2014/0091731 | A1* | 4/2014 | Fushimi | H05B 37/0245 315/292 |
| 2014/0111097 | A1* | 4/2014 | Ito | H04N 5/232 315/151 |
| 2014/0327364 | A1 | 11/2014 | Bischof et al. | |
| 2014/0339988 | A1* | 11/2014 | Nishigaki | H05B 37/0218 315/153 |
| 2015/0008845 | A1* | 1/2015 | Kim | H05B 37/0272 315/292 |
| 2015/0022123 | A1* | 1/2015 | Van De Sluis | H05B 37/0245 315/312 |
| 2015/0189723 | A1* | 7/2015 | Ogawa | H05B 37/0272 315/294 |

FOREIGN PATENT DOCUMENTS

| | | |
|---|---|---|
| DE | 102011053923 | 3/2013 |
| DE | 102011086702 | 5/2013 |
| KR | 1020110103124 | 9/2011 |
| WO | 2008104927 | 9/2008 |

OTHER PUBLICATIONS

Aristide et al. Master of Advanced Studies in Human Computer Interaction Design Master Thesis 2009/2010, English Translation attached to original, All together 137 Pages, "iLiving Interaction design for the living room of the future".

* cited by examiner

ILLUMINATION SYSTEM WITH AN AUTOMATIC LIGHT IDENTIFICATION SYSTEM FOR LOCATION-DEPENDENT LIGHTING CONFIGURATION, AND A METHOD FOR OPERATING AN ILLUMINATION SYSTEM

CROSS-REFERENCE TO RELATED APPLICATION

This application is the U.S. national phase of PCT Application No. PCT/EP2014/078148 filed on Dec. 17, 2014, which claims priority to DE Patent Application No. 10 2013 226 413.5 filed on Dec. 18, 2013, the disclosures of which are incorporated in their entirety by reference herein.

The invention relates to an illumination system and an associated method for operating an illumination system which enable an automatic identification of the lights and a control of the lights based on their respective position.

In the office domain, for example, light is mainly controlled in segmented areas or for the entire room. This means a loss of efficiency, since, for example, office workstations are illuminated even though they are not occupied, and also a restriction in flexibility, since, for example, the same dimming value, the same color temperature, etc., are defined uniformly for the entire area, even though the user would like to adjust the illumination of his workstation individually.

The display area in stores is also a very active, innovative area in which a wide variety of concepts are implemented. Nevertheless, light management is still hardly ever used in stores. Conventional arguments such as energy saving/dimming are of little relevance to store owners, since a high level of illumination must always be present because, from experience, "dark" is interpreted by customers as "closed".

Instead, the main concern in stores is to present the display items "in the best light". Colors and color temperatures need to be flexibly adjustable in order to illuminate the changing collections appropriately and guide the customer to the required display items.

In addition, display items are frequently changed in stores, e.g. in clothing stores. Here, special collections or special offers are to be given particular emphasis with the illumination. This is difficult to design according to the concepts of the current prior art with stationary (operating) devices. For example, the correct light has to be located on a stationary (operating) device. The lights are identified, for example, only by numbers (light address). In a store, however, there are typically a large number of lights. This means that it may take a very long time to locate the correct light. The employee in the office must also first locate his light.

Since the light is furthermore adjusted on the stationary (operating) device, it is not possible for the user to experience the effect of light (color/color temperature) directly on the display item. This means that he must constantly go back and forth between the light and the stationary (operating) device until he has found the correct adjustment. The same also applies to the workstation in the office area.

Moreover, an illumination system is known in which each individual light has a WLAN module via which the respective light can be controlled. In this illumination system, the lights equipped with WLAN modules are located, for example, via the signal strength or the transmission time of the wireless signal between the light and the mobile operating element. In particular, the lights can be controlled by means of a mobile operating device similarly having a WLAN module. The disadvantage of this, however, is that each light must be equipped with a corresponding expensive WLAN module and a precise determination of the positioning of the lights and also a control of the lights can be hampered by shadowing effects and the transmission strength (for example due to the light housing, pillars, ceilings, display items, etc.).

The object of the invention is to produce an illumination system and a method for operating an illumination system which guarantee a flexible and intuitive operation of the lights and simultaneously incur only low hardware costs.

The object is achieved according to the invention for the illumination system by the features of independent claim 1 and for the method by the features of independent claim 13. Advantageous developments form the subject matter of the subclaims back-referenced hereto.

An illumination system according to the invention contains a mobile operating device, a plurality of lights and a central control device. The central control device is configured to control the lights. The operating device has a position-sensing unit for determining the position of the operating device. In addition, it contains a display unit on which the positions of the lights and the position of the operating device can be displayed in combination. The operating device in this case enables a user to perform a (for example location-dependent or spatially defined) selection and operation of the displayed lights. The lights are controlled by means of the central control device according to an operation by the user. It is thus possible to achieve a very simple operation of the lights with simultaneously low hardware costs.

The illumination system according to the invention enables, for example by means of software running on the mobile device—which is used as an operating device—the position data of the light(s) to be combined with the user's own position, wherein preferably only the lights which are relevant, because they are surrounding, are displayed to the user as a result. The radius of lights to be displayed can preferably be user-adjustable. A fast configuration of the correct light(s) and the immediate experience of this setting in situ are enabled in this manner. The user does not have to control the lights from an operating device mounted on the wall, but can perform this directly in situ, as a result of which he can immediately monitor and adjust the effect of his settings, e.g. modified color temperature. Furthermore, the lights in his environment are preferably automatically displayed in combination with his own position, as a result of which the problem of controlling the incorrect lights or searching for the correct light is superfluous.

Since this solution can furthermore get by without a WLAN module (e.g. Bluetooth module) in each light, the illumination system according to the invention can be provided at a lower cost than known solutions of this type. Low-cost NFC chips (see below) are in any case installed in the lights, as a result of which only one central control device, for example with a router, is preferably required which provides the connection between the operating device and the control device. The present invention can furthermore be more reliably provided, since a wireless connection does not run via the lights (interference due to light housing, ceiling elements, other lights, etc., can thus be avoided), but, for example, a normal, conventional Wi-Fi network can be used.

The illumination system preferably has a position database which is configured to retain positions of the lights. The position database is preferably part of the operating device or the central control device. The operating device is configured to read the positions of the lights from the position database. It is thus possible to provide the operating device with the positions of the lights at low cost.

The lights preferably have a position memory in each case in which a position of the respective light can be stored. The position memories as part of the lights represent a very economical solution and thus contribute to the further reduction of hardware costs.

Furthermore, the operating device preferably has a writing unit. The operating device is then configured, in the event of an initialization of a light, to determine a current position of the operating device by means of the position-sensing unit, and to write the current position of the operating device to the position memory of the respective light by means of the writing unit. The light is configured to transmit, in the event of an initialization of the respective light, a position of the light stored in the position memory of the light to the position database. A costly WLAN connection of the light is then no longer required.

The position memories are preferably embedded in RFID chips. The writing unit is then an RFID chip reader. Very economical standard components can thus be used. For example, it is thus enabled that the lights are addressed by means of an NFC chip. A mobile operating device which, for example, an electrician uses when fitting the lights or the system transmits the position data determined, for example, via indoor positioning, to the light by means of NFC. The term "indoor positioning" is understood to mean the determination of the position inside the building by combining the last GPS and/or Wi-Fi data with the data of different sensors, such as acceleration sensors, pressure sensors and gyroscopes.

In each case, the operating device and the central control device advantageously have a wireless communication interface. The operating device and the central control device are then configured to perform the control of the lights by the operating device via the central control device by means of the wireless communication interface. A further simplification of operation is thus possible.

Furthermore, the central control device preferably has a lighting control interface. The respective lights then similarly have a compatible lighting control interface. In this case, the central control device and the lights are configured so that the lights are controlled by the central control device by means of the lighting control interfaces of the central control device and of the lights. The lighting control interfaces are preferably DALI interfaces in this case. Economical standard components can thus also be used, contributing to a reduction of overall costs. It is furthermore conceivable for the position data of the light which is preferably determined by means of the operating device and transmitted to the light to be sent during the initialization to the central control device which then, for example, creates an automatic system map (geographical position of all lights). By means of this system map, which can preferably be transmitted to the operating device, the user can simply and quickly locate the correct light which he would like to control (for example dim, switch, configure, etc.) through combined reproduction of the light positions and the position of the operating device.

Furthermore, the operating device is preferably configured to display on the display unit the positions only of lights within a user-adjustable or predefined radius around the determined position of the operating device. The amount of information presented to the user is thus reduced, particularly in the case of installations with a multiplicity of lights. Operation is further simplified as a result.

Furthermore, the operating device is particularly advantageously configured in such a way that only the position of one light (or some lights) closest to the determined position of the operating device is displayed on the display unit. This ensures a very simple facility for selecting a specific light which is intended to be controlled. Since the light(s) is/are located close to the operating device, the operator can perform the control according to the given illumination situation in situ.

Furthermore, the operating device is preferably configured to display the positions of the displayed lights and the position of the operating device on the display unit in a top view representation according to the respective positions. A very simple and intuitive operation by the user can thus be implemented.

The operating device is preferably configured to display the positions of the displayed lights and the position of the operating device on the display unit in a map representation with additional information relating to a respective environment. The additional information is retained in the position database in this case. A particularly clearly laid out representation is thus possible.

Furthermore, the operating device and the central control device are preferably configured to enable a control of an ON state and/or a dimming state and/or a color temperature and/or a temporal illumination sequence of the individual lights. Extensive operation simply by means of the operating device is thus possible. This ensures very simple and intuitive operability.

A method according to the invention serves to operate an illumination system with a mobile operating device, a plurality of lights and a central control device. The central control device controls the lights in this case. The operating device senses a position of the operating device. This is preferably done by means of a position-sensing unit. Furthermore, the operating device displays the positions of at least some of the lights and its own position in combination. A user selects the light(s) which are to be controlled by means of a display unit and performs an operation. The lights are controlled by the central control device according to the operation by the user. Very simple and intuitive operation with low hardware costs is thus possible.

The invention is described below by way of example with reference to the drawings in which an advantageous example embodiment of the invention is shown. In the drawings.

Figure 1:
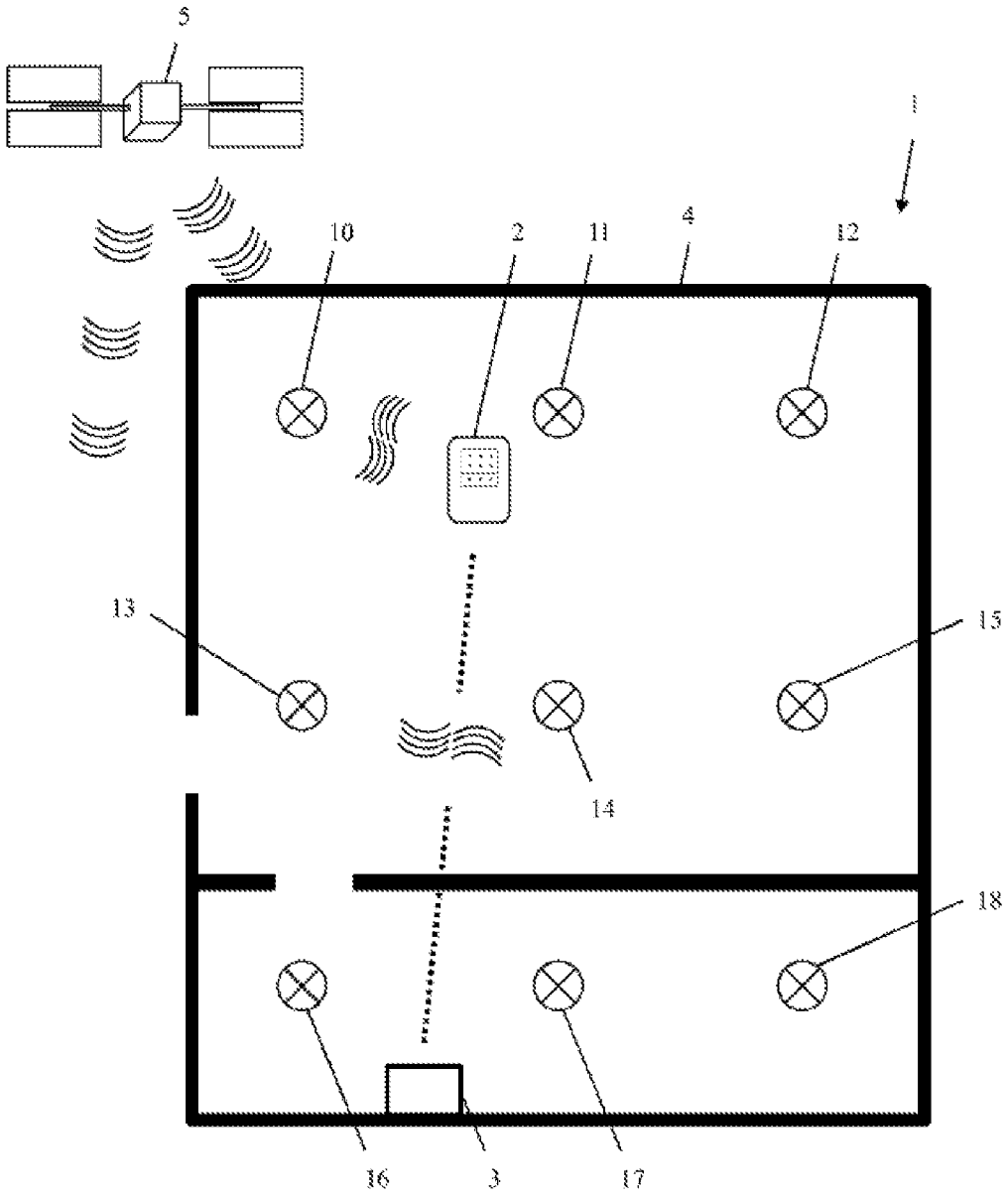
FIG. 1 shows a first example embodiment of the illumination system according to the invention.

The underlying problem and the general structure of an example embodiment of the illumination system according to the invention are first shown with reference to FIG. 1. The detailed structure of the example embodiment of the illumination system according to the invention is then examined with reference to FIG. 2-FIG. 4. Finally, the mode of operation of an example embodiment of the method according to the invention for operating an illumination system is examined with reference to FIG. 5-FIG. 6. Identical elements have been presented and described in similar illustrations in part without repetition.

FIG. 1 shows an example embodiment of the illumination system 1 according to the invention. The illumination system contains an operating device 2, a central control device 3 and a plurality of lights 10-18. In this case, the illumination system 1 is installed in a building 4. A GPS satellite 5 is furthermore shown by way of example to indicate that an unrestricted GPS reception is possible outside the building 4, whereas a GPS reception is not possible or is only restrictedly possible inside the building 4.

The operating device 2 is preferably connected via a wireless communication interface to the central control device 3. WLAN or Bluetooth, for example, is used for this purpose. Each of the lights 10-18 preferably has a position memory which is integrated e.g. into an RFID chip. Information relating to the current position of the respective light 10-18 can be stored in the position memory. The operating device 2 preferably has a writing unit, for example an RFID chip writer, for storing a position of the respective lights 10-18 in the position memory.

The operating device 2 furthermore has a position-sensing unit which senses the position of the operating device 2. GPS signals can be used for this purpose. Due to the unreliable availability of GPS signals inside buildings, the position-sensing unit can additionally have further sensors for determining the exact position, for example by means of "indoor positioning". For example, the position-sensing unit may contain a gyroscope for the relative determination of the position. The position-sensing unit may also, for example, have data from a radiocommunication network, such as e.g. information relating to base stations of a GSM network. Alternatively, a use of WLAN networks for position determination is also conceivable. A combination of a plurality of these position determination possibilities is also conceivable.

Furthermore, the illumination system 1 preferably has a position database in which the positions of the lights and optionally additional information are stored. The operating device 2 is configured to read the positions of the lights from the position database.

During a light initialization procedure, the operating device 2 is moved close to the corresponding light and the position determined by the operating device 2 is stored in the position memory of the light. The light then forwards the position to the position database which stores it, preferably in the form of a system map. The light thus no longer requires a costly WLAN interface and its own position sensing.

The operating device 2 can retrieve the position data of the lights or the system map from the position database and thus has the position of the lights 10-18 and also its own position which can thus be provided in combination. This information is displayed in combination to a user, preferably on a display unit. In particular, a top-view representation is suitable here. This means that the positions of the lights 10-18 and the position of the operating device 2 are shown in a top view in a reduced representation in their respective position. The user can then initiate an operating procedure by selecting individual or a plurality of lights 10-18.

In particular, an adjustment of the switching state, the dimming state, the color temperature and an illumination sequence is possible. Further operating procedures are also conceivable. In particular, a map representation of the positions of the lights 10-18 and of the operating device 2 with additional information, relating, for example, to the present environment, is additionally conceivable. For example, an outline or a section (room, surroundings of the operating device within a predefined radius around the operating device, etc.) of the building 4 could thus represent additional information of this type. The operating device 2 can similarly extract this additional information from the position database.

Operating procedures carried out by the user are then transmitted via a wireless communication interface to the central control device 3 which is connected to the lights 10-18 (preferably directly by means of DALI) and carries out the actual control procedure.

Figure 2:
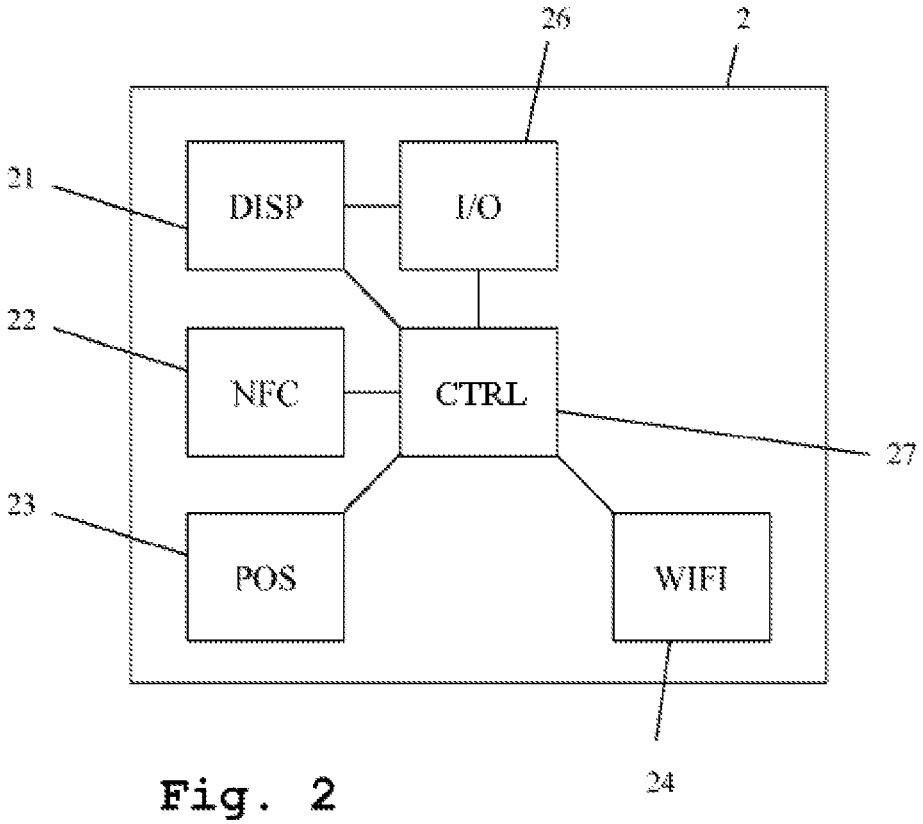
FIG. 2 shows a first detailed view of the example embodiment of the illumination system according to the invention in a block diagram.

FIG. 2 shows an example of a detailed view of the operating device 2 from FIG. 1 in a block diagram. The operating device 2 has a display unit 21, a writing unit 22, a position-sensing unit 23, a wireless communication interface 24 and an input/output unit 26. In addition, all of these units 21-26 are preferably connected to a central control device 27. In addition, the display unit 21 is preferably connected to the input/output unit 26. The control unit 27 is preferably configured to control all remaining units.

A combined representation of the positions of the lights 10-18 from FIG. 1 and of the operating device 2 is generated or implemented by means of the input/output unit 26 on the display unit 21. The input/output unit 26 is responsible in this case for representing the content of the display unit 21. In addition, the input/output unit 26 preferably processes inputs of the user and transfers them to the control device 27. It thus captures commands of the user entered, for example, via a touch-sensitive screen of the display unit 21 and transmits them to the control device 27. The writing unit 22 is, for example, an RFID chip writer. However, other near field communication standards can also be used. The writing unit 22 serves to store the positions of the lights 10-18 in the position memory of the lights 10-18. The position-sensing unit 23 serves to determine the position of the operating device 2 and thus the position of a light that has just been initialized. It determines the exact position of the operating device 2 on the basis of GPS and/or WLAN signals and/or signals from mobile communication networks and/or signals of an integrated magnetometer and/or signals of an integrated gyroscope and/or indoor positioning. On the basis of these numerous optionally available information sources, the position-sensing unit 23 determines a final position of the operating device 2. The wireless communication interface 24 is used here for communication with the central control device 3 from FIG. 1.

Figure 3:
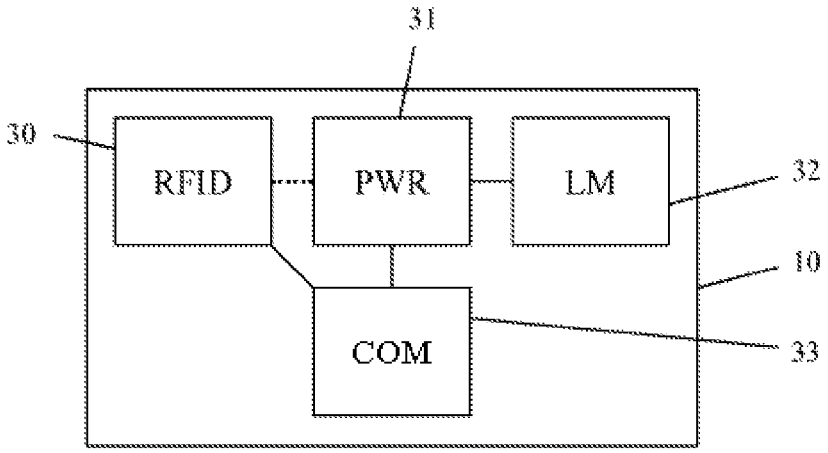
FIG. 3 shows a second detailed view of the example embodiment of the illumination system according to the invention in a block diagram.

FIG. 3 shows a second detailed view of the example embodiment of the illumination system 1 according to the invention. A light 10 is shown here by way of example in a block diagram. The light 10 preferably contains a position memory 30 which is integrated here into an RFID chip. Furthermore, the light 10 preferably contains a power supply 31, a lighting means 32 and a communication interface 33. Information relating to the current position of the light 10 is or can be stored in the position memory 30. The position memory 30 is optionally connected to the power supply 31 and is optionally supplied with power by the power supply 31. In addition, the position memory 30 is preferably connected to the communication interface 33. Furthermore, the power supply 31 is preferably connected to the communication interface 33 and supplies the latter with power. The power supply may be integrated into the light; alternatively, the light may also be supplied via an external power source or power feed. The communication interface 33 is used for communication with the central control device 3 from FIG. 1. The communication interface 33 is, for example, a bus system, such as e.g. DALI. Alternatively, the communication interface 33 may also be wirelessly configured. The communication interface 33 is used, on the one hand, for the control of the lighting means 32 by the central control device 3. On the other hand, the position(s) of the light(s) 10-18 which was/were determined by the operating device 2 during the initialization is/are transmitted to the position database by means of the communication interface 33.

The lighting means 32 is furthermore connected to the power supply 31 and is supplied with power by the power supply 31. In addition, the light to be emitted by the lighting means 32 is adjusted by the power supply 31. The latter receives control signals by means of the communication interface 33 and converts them into a modified control of the lighting means 32. The power supply 31 is thus configured to adjust the switching state and/or the color temperature and/or the dimming state and/or illumination sequences, etc.

Figure 4:
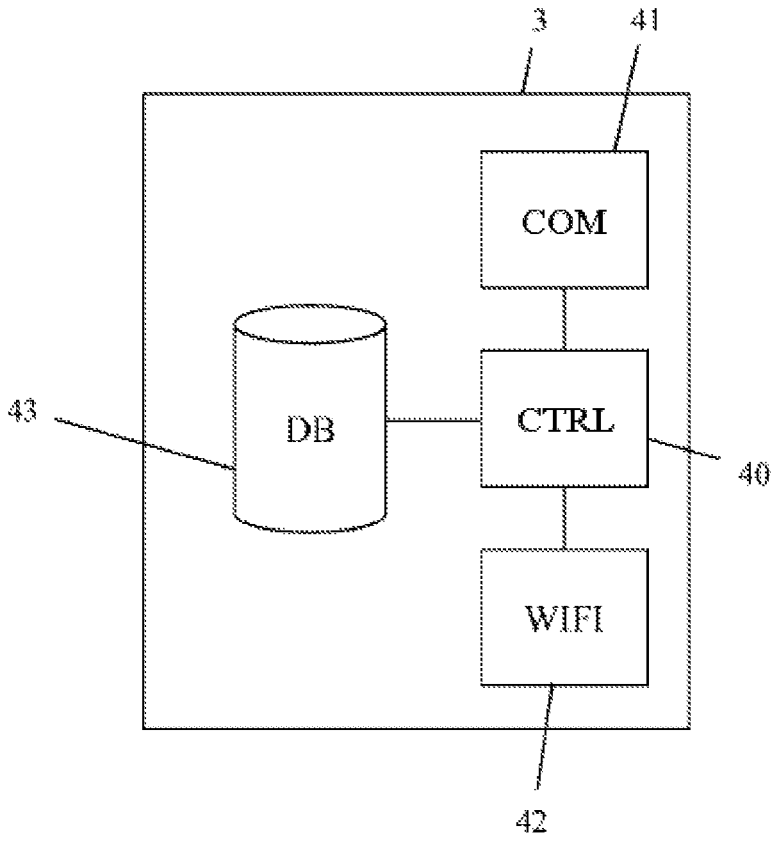
FIG. 4 shows a third detailed view of the example embodiment of the illumination system according to the invention in a block diagram.

FIG. 4 shows a third detailed view of the example embodiment of the illumination system 1 according to the invention. The central control device 3 from FIG. 1 is shown here in a block diagram. The central control device 3 preferably contains a control unit 40, a communication interface 41, a wireless communication interface 42 and a position database 43.

The control device 40 is preferably configured to control the remaining devices 41, 42. The central control device 3 preferably receives operating information from the operating device 2 via the wireless communication interface 42. Said information is preferably transmitted to the control device 40 and processed. Control commands are preferably transmitted by means of the communication interface 41 to the lights 10-18 from FIG. 1. Switching states, dimming states, color temperatures and/or illumination sequences of the lights 10-18 can preferably be controlled.

The position database retains the positions of the lights 10-18 which have been determined, for example, by the operating device 2 and have been transmitted from the respective light 10-18 to the position database 43. In addition, it can retain additional information which can be retrieved by the operating device if required. For example, this may be map information relating to the area in which the illumination system is installed. The position data of the lights can be stored, for example, in the form of a position profile or system map in the position database.

Figure 5:
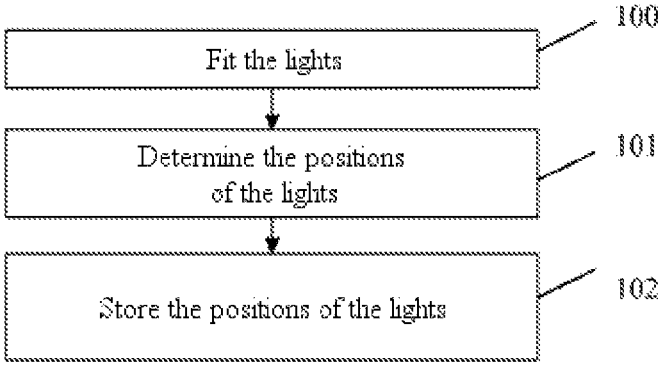
FIG. 5 shows a first partial view of an example embodiment of the method according to the invention in a flow diagram.

FIG. 5 shows a first part of an example embodiment of the method according to the invention in a flow diagram. In a first step 100, the lights are fitted e.g. by an electrician at their respective positions. The position of the lights 10-18 is detected by means of an operating device, e.g. the operating device 2 from FIG. 1. This is carried out in a second step 101. In a third step 102, the determined positions of the lights are preferably stored in the respective position memories of the lights and are forwarded to a position database and are similarly stored by the latter, preferably in the form of a position profile (for example a system map). Thus, the lights and the position database then have the respective positions of the lights. The sequence shown in FIG. 5 corresponds to the sequence in a first installation of the illumination system or a light. It is repeated only in the event of a position change or addition of one or more of the lights.

Figure 6:
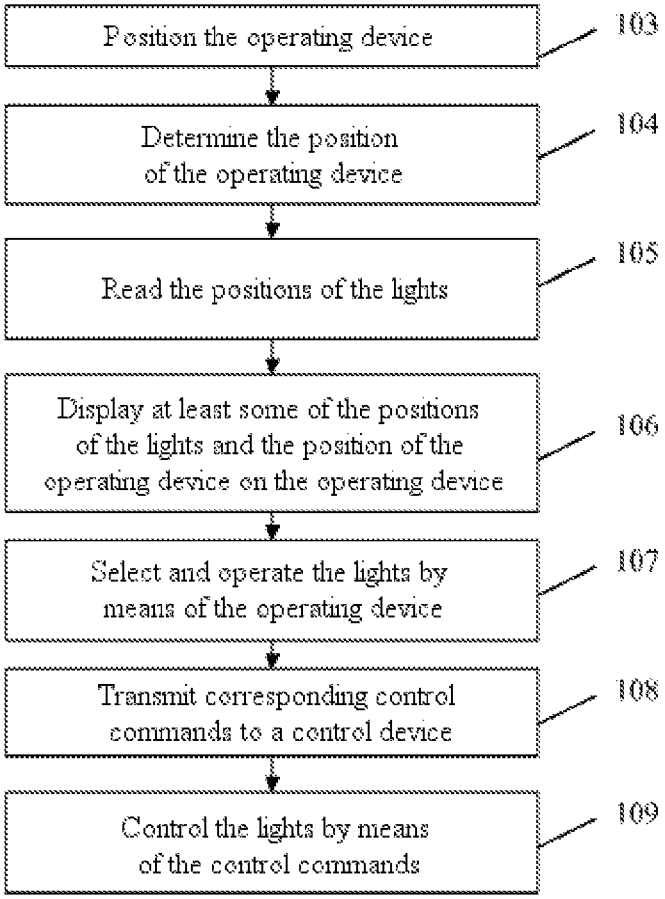
FIG. 6 shows a second part of the example embodiment of the method according to the invention in a flow diagram.

FIG. 6 shows a second part of the example embodiment of the method according to the invention in a flow diagram. The sequence shown here corresponds to the sequence in the event of a modification of an illumination state desired by a user. In a first step 103, an operating device, e.g. the operating device 2 from FIG. 1, is positioned close to lights which are to be controlled. The position of the operating device is determined in a second step 104. For example, GPS, WLAN signals, a gyroscope etc. are used in this case. In a third step 105, the position of lights which are located close to the operating device or all or part of the system map/position profile is read from the position database. The term "close" is understood according to the invention in this context to mean that lights are selected which are located in a selected or predefined area in relation to or around the operating device 2; for example within a specific radius around the operating device 2.

In a fourth step 106, the positions of (some of) the lights and the position of the operating device are presented to a user in combination on a display of the operating device. All detected lights can be displayed in this case. Alternatively, only lights which are located within a user-defined or predefined area/radius around the position of the operating device are displayed. In addition, a restriction to the light(s) closest to the operating device is also possible. In addition, a restriction to individual areas (for example rooms) within the building is also conceivable. The user can preferably actively choose between these options. In a fifth step 107, a selection and operation of the lights is performed by the user by means of the operating device. In a sixth step 108, corresponding control commands are transmitted from the operating device to a central control device. In a seventh step 109, the lights are controlled by means of the control commands. In one advantageous development, the central control device performs a translation of the control commands of the operating device into control commands for the lights.

By means of the preferred embodiments according to the invention, a mobile device which is used for addressing can simultaneously serve as the operating device 2. It preferably communicates wirelessly with the central control device 3, for example via a router, as a result of which a low-cost, location-dependent lighting configuration can be implemented. Furthermore, the central control device 3 can transmit the position of the lights (for example the system map), for example via a router (e.g. by means of a WLAN signal), to the mobile operating device 2. The mobile operating device 2 recognizes its position, for example by means of indoor positioning, wherein, for example, software of the operating device 2 combines these two information elements so that e.g. only the lights in the vicinity (for example the light under which someone is currently standing) are displayed. The radius of lights that are to be displayed is preferably adjustable by the user via the operating device 2.

The invention is not limited to the example embodiment shown. In particular, no limitation to specific possibilities for position sensing or specific standards for communication between the operating device and the lights and between the operating device and the central control device and between the central control device and the lights is part of the invention.

All of the features described above or features shown in the figures can be advantageously combined with one another in any given manner within the scope of the invention.

The invention claimed is:

1. An illumination system with a mobile operating device, comprising:

a plurality of lights and a central control device, wherein the central control device is configured to control the lights, wherein the operating device has a position-sensing unit which is configured to sense the position of the operating device, in that the operating device has a display unit which is configured to display positions of at least some of the lights and the position of the operating device in combination, and in that the operating device is configured to enable a user to perform a selection and operation of at least the displayed part of the lights by means of the display unit, and to control the lights by means of the central control device according to the operation by the user.

2. The illumination system as claimed in claim 1, wherein the illumination system has a position database which is configured to retain positions of the lights, wherein the position database is preferably part of the operating device or of the central control device, and in that the operating device is configured to read the positions of the lights from the position database.

3. The illumination system as claimed in claim 2, wherein the lights have position memories which are configured to store a position of the respective light.

4. The illumination system as claimed in claim 3, wherein the operating device has a writing unit, the operating device is configured, in the event of an initialization of a light, to determine a current position of the operating device by means of the position-sensing unit, and to write a position of the operating device to the position memory of the respective light by means of the writing unit, and the light is configured, in the event of an initialization of the respective light, to transmit a position of the light stored in the position memory of the light to the position database.

5. The illumination system as claimed in claim 3, wherein the position memories are embedded in RFID chips, and the writing unit is an RFID chip writer.

6. The illumination system as claimed in claim 1, wherein the operating device has a wireless communication interface, the central control device has a wireless communication interface, and the operating device and the central control device are configured in such a way that the lights are controlled by the operating device via the central control device by means of the wireless communication interfaces.

7. The illumination system as claimed in claim 1, wherein the central control device has a lighting control interface, the lights in each case have a lighting control interface, the central control device and the lights are configured in such a way that the lights are controlled by the central control device by means of the lighting control interfaces of the central control device and of the lights, and the lighting control interfaces are preferably DALI interfaces.

8. The illumination system as claimed in claim 1, wherein the operating device is configured to display on the display unit the positions only of lights within a user-adjustable or predefined radius around the determined position of the operating device.

9. The illumination system as claimed in claim 1, wherein the operating device is configured to display on the display unit the positions of only one or some of the lights closest to the determined position of the operating device.

10. The illumination system as claimed in claim 1, wherein the operating device is configured to display the positions of the displayed lights and the position of the operating device on the display unit in a top view representation according to the respective positions.

11. The illumination system as claimed in claim 2, wherein the operating device is configured to display the positions of the displayed lights and the position of the operating device on the display unit in a map representation with additional information relating to a respective environment, and the additional information relating to the respective environment is retained in the position database.

12. The illumination system as claimed in claim 1, wherein the operating device and the central control device are configured to enable a control of an ON state and/or a dimming state and/or a color temperature and/or a temporal illumination sequence of the individual lights.

13. A method for operating an illumination system with a mobile operating device, a plurality of lights and a central control device, wherein the central control device controls the lights, wherein the position of the operating device is sensed by means of a position-sensing unit of the operating device, positions of at least some of the lights and the position of the operating device are displayed in combination by a display unit of the operating device, and the operating device is configured to enable a user to perform a selection and operation of at least the displayed part of the lights by means of the display unit, and the lights are controlled by means of the central control device according to the operation by the user.

14. The method as claimed in claim 13, wherein the illumination system has a position database in which information relating to positions of the lights is retained, and information relating to the positions of the lights is read from the position database by the operating device.

15. The method as claimed in claim 14, wherein the lights have position memories in which information relating to a position of the respective light is stored, the operating device, in the event of an initialization of a light, determines a current position of the operating device, and writes a position of the operating device to the position memory of the respective light by means of a writing unit, and wherein the light, in the event of an initialization of the respective light, transmits a position of the light stored in the position memory of the light to the position database.

* * * * *